US009598190B2

(12) United States Patent
Uehara et al.

(10) Patent No.: US 9,598,190 B2
(45) Date of Patent: Mar. 21, 2017

(54) PAPER SHEET BUNDLING APPARATUS

(75) Inventors: Osamu Uehara, Tokyo (JP); Tsuyoshi Hodatsu, Saitama (JP); Tomomi Inoue, Tokyo (JP)

(73) Assignee: GLORY LTD., Himeji-shi, Hyogo-ken (JP)

( * ) Notice: Subject to any disclaimer, the term of this patent is extended or adjusted under 35 U.S.C. 154(b) by 634 days.

(21) Appl. No.: 14/123,561

(22) PCT Filed: May 28, 2012

(86) PCT No.: PCT/JP2012/063583

§ 371 (c)(1),
(2), (4) Date: Jan. 27, 2014

(87) PCT Pub. No.: WO2012/165360

PCT Pub. Date: Dec. 6, 2012

(65) Prior Publication Data

US 2014/0130450 A1 May 15, 2014

(30) Foreign Application Priority Data

Jun. 3, 2011 (JP) ..... 2011-125243

(51) Int. Cl.
*B65B 27/08* (2006.01)
*B65B 13/18* (2006.01)
(Continued)

(52) U.S. Cl.
CPC ..... *B65B 27/08* (2013.01); *B65B 61/26* (2013.01); *G07D 11/0081* (2013.01);
(Continued)

(58) Field of Classification Search
CPC ..... B65B 61/26; B65B 27/08; B65B 13/18; G07D 11/0081; G07D 11/0084; G07D 11/0021
(Continued)

(56) References Cited

U.S. PATENT DOCUMENTS 4,402,410 A * 9/1983 Ohba et al. ..... G07D 11/0084 209/534
4,424,660 A * 1/1984 Sato et al. ..... G07D 11/0084 414/789.2
(Continued)

FOREIGN PATENT DOCUMENTS

CN 1763790 A 4/2006
CN 101362517 A 2/2009
(Continued)

OTHER PUBLICATIONS

PCT machine translation of WO 2010109642 A1, retrieved Jul. 8, 2016, 22 pages.*
(Continued)

*Primary Examiner* — Stephen F Gerrity
(74) *Attorney, Agent, or Firm* — Renner, Kenner, Greive, Bobak, Taylor & Weber

(57) ABSTRACT

A paper sheet bundling apparatus includes a bundling unit 22 configured to bundle bundling target paper sheets using a bundling band and make a batch of paper sheets, a stamp affixing unit 71 configured to affix a stamp to the bundling band of the batch of paper sheets, a memory unit 180 configured to store therein an association between the kind of paper sheet and a stamp affixing position on the bundling band or the paper sheet, and a control unit 170 configured to obtain a stamp affixing position corresponding to the kind of the bundling target paper sheets with reference to the association, and adjust a positional relation between the stamp and the bundling band or the batch of paper sheets at a time of affixing the stamp, on a basis of the obtained stamp affixing position.

9 Claims, 11 Drawing Sheets

(51) Int. Cl.
*B65B 61/26* (2006.01)
*G07D 11/00* (2006.01)

(52) U.S. Cl.
CPC ..... *B65B 13/18* (2013.01); *G07D 11/0021* (2013.01); *G07D 11/0084* (2013.01)

(58) Field of Classification Search
USPC ..... 53/411, 64, 74, 131.2, 131.4; 100/4
See application file for complete search history.

(56) References Cited

U.S. PATENT DOCUMENTS

| | | | | |
|---|---|---|---|---|
| 4,539,789 | A * | 9/1985 | Miyano et al. | B65B 27/08 100/33 PB |
| 4,825,378 | A * | 4/1989 | Yuge | G07D 11/0084 209/534 |
| 5,012,932 | A * | 5/1991 | Omura et al. | G07D 11/0084 209/534 |
| 7,600,626 | B2 * | 10/2009 | Hallowell et al. | B65B 27/08 194/206 |
| 7,604,425 | B2 * | 10/2009 | Otsuka | B65B 27/08 194/206 |
| 8,122,686 | B2 * | 2/2012 | Kollmuss | B65B 11/10 53/411 |
| 2001/0002574 | A1 * | 6/2001 | Miyazaki | B65B 61/26 101/35 |
| 2002/0153290 | A1 * | 10/2002 | Otsuka | B65B 27/08 209/534 |
| 2005/0060956 | A1 * | 3/2005 | Yui | B65B 27/08 53/399 |
| 2005/0241270 | A1 * | 11/2005 | Katsumata | B65B 27/08 53/64 |
| 2006/0076213 | A1 * | 4/2006 | Sekiguchi et al. | G07D 11/0084 194/206 |
| 2006/0157390 | A1 * | 7/2006 | Otsuka | G07D 11/0084 209/534 |
| 2006/0283341 | A1 * | 12/2006 | Otsuka | B65B 27/08 101/35 |
| 2009/0013653 | A1 * | 1/2009 | Sekiguchi et al. | G07D 11/0084 53/531 |
| 2009/0057093 | A1 * | 3/2009 | Iwami et al. | G07D 11/0081 194/206 |
| 2009/0229950 | A1 * | 9/2009 | Nakamoto | G07D 11/0084 194/302 |
| 2010/0125515 | A1 * | 5/2010 | Aso et al. | G06Q 40/00 705/35 |
| 2010/0326789 | A1 * | 12/2010 | Yokota | G07D 11/0084 194/206 |
| 2011/0072987 | A1 * | 3/2011 | Nobuhara et al. | G07D 11/0084 100/7 |
| 2011/0125313 | A1 * | 5/2011 | Hodatsu et al. | G07D 11/0084 700/223 |
| 2012/0011813 | A1 | 1/2012 | Nakai et al. | |

FOREIGN PATENT DOCUMENTS

| | | | |
|---|---|---|---|
| JP | 2001-357428 | 12/2001 | |
| JP | 2003-211809 | 7/2003 | |
| JP | 2003-281598 | 10/2003 | |
| JP | 2003-300501 | 10/2003 | |
| JP | 2009-42938 | 2/2009 | |
| WO | WO 2009110077 A1 * | 9/2009 | B65B 27/08 |
| WO | WO 2010/103618 A1 | 9/2010 | |
| WO | WO 2010103619 A1 * | 9/2010 | G07D 11/0021 |
| WO | WO 2010103620 A1 * | 9/2010 | G07D 11/0021 |
| WO | WO 2010109616 A1 * | 9/2010 | B65B 27/08 |
| WO | WO 2010109642 A1 * | 9/2010 | B65B 27/08 |

OTHER PUBLICATIONS

PCT machine translation of WO 2010103618 A1, retrieved Jul. 8, 2016, 25 pages.*
WIPO machine translation of WO-2010103618-A1, retrieved Nov. 30, 2016, 32 pages.*
WIPO machine translation of WO-2010103620-A1, retrieved Nov. 30, 2016, 17 pages.*
European Search Report (Application No. 12792030.4) (5 pages—dated Feb. 10, 2014).
Japanese Office Action (JP Application No. 2011-125243) with English Translation (6 pages—dated Mar. 10, 2015).
Decision of Rejection (JP Application No. 2011-125243) with English Translation (4 pages—dated Oct. 2, 2015).
Chinese Office Action with English Translation (Chinese Patent Application No. 201280025967.4) (11 pages—dated Jun. 17, 2014).

* cited by examiner

CURRENCY : EURO

| DENOMINATION / FACE/BACK, ORIENTATION | 5 EURO | 10 EURO | 20 EURO | ・・・ |
|---|---|---|---|---|
| FACE-UP,UPWARD | (10,20) | (15,30) | (10,25) | ・・・ |
| FACE-UP,DOWNWARD | (30,30) | (40,45) | (30,35) | ・・・ |
| FACE-DOWN,UPWARD | (30,20) | (40,30) | (30,25) | ・・・ |
| FACE-DOWN,UPWARD | (10,30) | (15,45) | (10,35) | ・・・ |

FIG.7

PAPER SHEET BUNDLING APPARATUS

TECHNICAL FIELD

The present invention relates to a paper sheet bundling apparatus that bundles paper sheets in a unit of a predetermined number of sheets.

BACKGROUND ART

A known paper sheet bundling apparatus bundles various paper sheets typified by banknotes using a bundling band for each predetermined number of sheets, and affixes a stamp to the bundling band after the bundling (see, for example, Patent Literature 1). Moreover, another known paper sheet bundling apparatus checks the printing density of a stamp affixed to a bundling band, and adjusts stamp affixing time and stamp affixing intervals on the basis of the checking results, to thereby stabilize a stamp affixing state (see, for example, Patent Literature 2).

If a plurality of paper sheets are put on top of each other, irregularities occur on the surface due to ink, security threads, and the like. There is a problem that, if portions in which such irregularities occur are bundled using a bundling band and a stamp is affixed thereto, partial missing of the affixed stamp occurs, and the affixed stamp is difficult to read.

CITATION LIST

Patent Literature

Patent Literature 1: Japanese Patent Laid-Open No. 2003-300501

Patent Literature 2: Japanese Patent Laid-Open No. 2003-211809

SUMMARY OF INVENTION

Technical Problem

The present invention has an object to provide a paper sheet bundling apparatus capable of preventing occurrence of partial missing of an affixed stamp.

Solution to Problem

A paper sheet bundling apparatus according to an aspect of the present invention includes: a bundling unit configured to bundle bundling target paper sheets using a bundling band and make a batch of paper sheets; a stamp affixing unit configured to affix a stamp to the bundling band of the batch of paper sheets; a memory unit configured to store therein an association between the kind of paper sheet and a stamp affixing position on the bundling band or the paper sheet; and a control unit configured to obtain a stamp affixing position corresponding to the kind of the bundling target paper sheets with reference to the association, and adjust a positional relation between the stamp and the bundling band or the batch of paper sheets at a time of affixing the stamp, on a basis of the obtained stamp affixing position.

A paper sheet bundling apparatus according to another aspect of the present invention includes: a bundling unit configured to bundle bundling target paper sheets using a bundling band and make a batch of paper sheets; a stamp affixing unit configured to affix a stamp to the bundling band of the batch of paper sheets; a memory unit configured to store therein an association between the kind of paper sheet and a stamp affixing impossible position on the bundling band or the paper sheet; and a control unit configured to obtain a stamp affixing position corresponding to the kind of the bundling target paper sheets with reference to the association, and adjust a positional relation between the stamp and the bundling band or the batch of paper sheets at a time of affixing the stamp, on a basis of the obtained stamp affixing position.

In the paper sheet bundling apparatus according to any of the aspects of the present invention, preferably, the paper sheets are banknotes, and the kind includes a denomination.

In the paper sheet bundling apparatus according to any of the aspects of the present invention, preferably, the kind includes at least any one of fitness and the kind of banknote.

In the paper sheet bundling apparatus according to any of the aspects of the present invention, preferably, the kind includes face/back and orientation.

In the paper sheet bundling apparatus according to any of the aspects of the present invention, preferably, the control unit obtains the stamp affixing position in accordance with a ratio of fit notes to unfit notes or a ratio of new version notes to old version notes, the notes being included in the batch of paper sheets.

In the paper sheet bundling apparatus according to any of the aspects of the present invention, preferably, the control unit obtains the stamp affixing position in accordance with a ratio of face-up notes to face-down notes included in the batch of paper sheets or an orientation-based ratio.

In the paper sheet bundling apparatus according to any of the aspects of the present invention, preferably, the control unit adjusts a position of the batch of paper sheets with respect to the stamp, on the basis of the obtained stamp affixing position.

In the paper sheet bundling apparatus according to any of the aspects of the present invention, preferably, the control unit adjusts a position of the stamp with respect to the batch of paper sheets, on the basis of the obtained stamp affixing position.

In the paper sheet bundling apparatus according to any of the aspects of the present invention, preferably, the control unit gives the bundling unit an instruction about a bundling position of the bundling band, on the basis of the obtained stamp affixing position.

In the paper sheet bundling apparatus according to any of the aspects of the present invention, preferably, the memory unit further stores therein an association between the kind of paper sheet and a stamp affixing impossible position on the bundling band, and the control unit obtains the stamp affixing position with reference to the association between the kind of paper sheet and the stamp affixing position and the association between the kind of paper sheet and the stamp affixing impossible position.

Advantageous Effect of Invention

According to the present invention, at the time of affixing a stamp to a bundling band, it is possible to prevent occurrence of partial missing of the affixed stamp.

BRIEF DESCRIPTION OF DRAWINGS

FIG. 7 is a diagram illustrating an example of an association between the kind of paper sheet and a stamp affixing position.

DESCRIPTION OF EMBODIMENTS

Hereinafter, embodiments of the present invention are described with reference to the drawings.

First Embodiment

Figure 1:
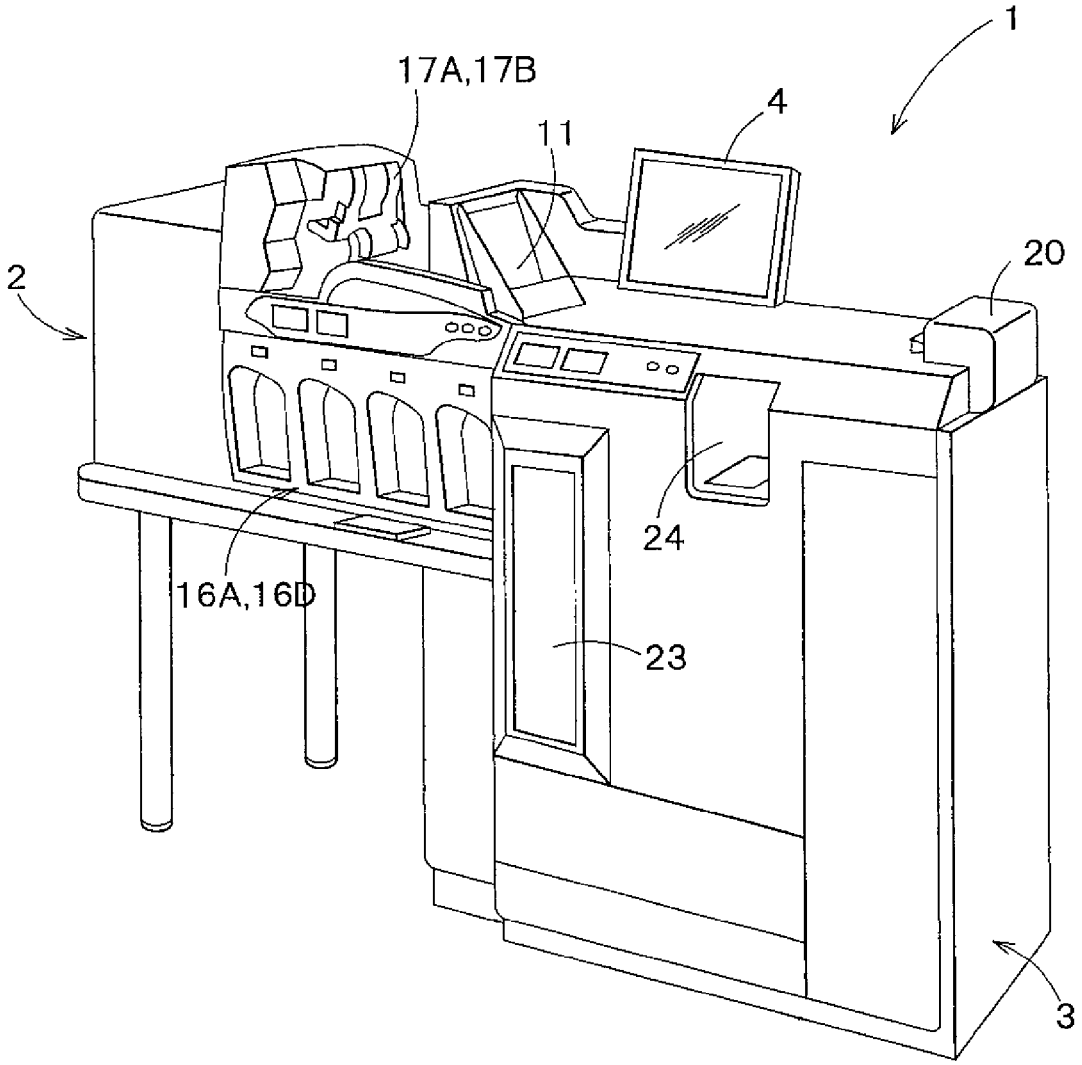
FIG. 1 is an external perspective view of a paper sheet processing apparatus according to a first embodiment of the present invention.
Figure 2:
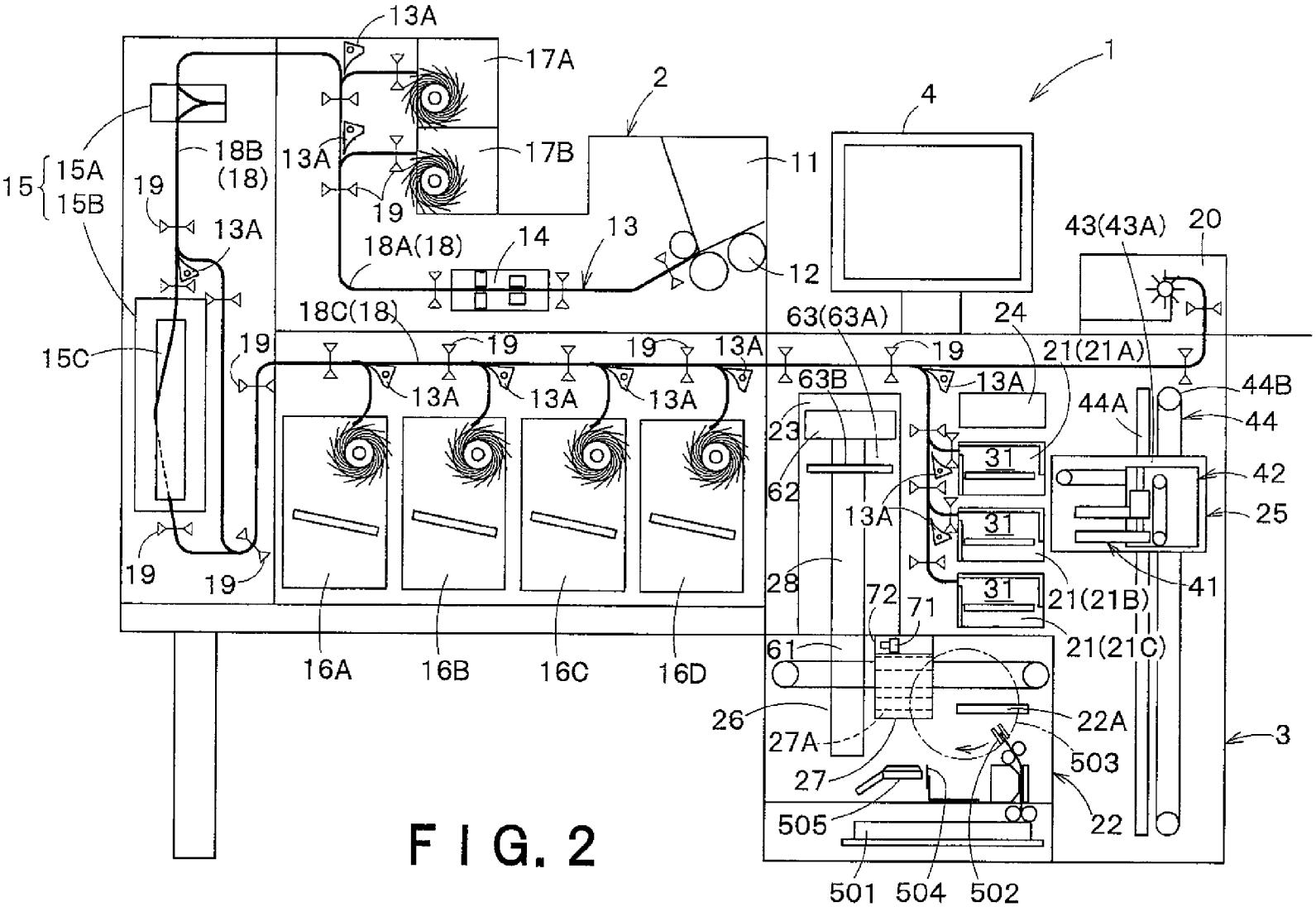
FIG. 2 is a schematic configuration diagram of the inside of the paper sheet processing apparatus according to the first embodiment.

FIG. 1 is an external perspective view of a paper sheet processing apparatus according to a first embodiment of the present invention, and FIG. 2 is a schematic configuration diagram of the inside of the paper sheet processing apparatus.

The paper sheet processing apparatus 1 includes a paper sheet sorting apparatus 2 and a paper sheet bundling apparatus 3. The paper sheet sorting apparatus 2 continuously deposits paper sheets such as banknotes and gift certificates, sorts and stacks the deposited paper sheets in accordance with the kind of paper sheet, and counts the number of the deposited paper sheets for each kind. The paper sheet bundling apparatus 3 bundles paper sheets of a particular kind sorted by the paper sheet sorting/stacking apparatus 2 in a unit of a predetermined number of sheets, for example, in a unit of 100 sheets. The paper sheet processing apparatus 1 further includes a display apparatus 4 configured to display various pieces of information such as counting results.

The paper sheet sorting apparatus 2 includes: a hopper unit 11 configured to put paper sheets into the apparatus; a feeding unit 12 configured to feed the paper sheets put into the hopper unit 11, in a unit of one sheet; a transport unit 13, such as a transport belt, configured to transport the paper sheets fed by the feeding unit 12; a recognition unit 14 configured to recognize the kind of each paper sheet transported by the transport unit 13; and a reversing unit 15 configured to reverse the paper sheets transported by the transport unit 13, on the basis of the recognition results obtained by the recognition unit 14, for example, face/back information and orientation information. The reversing unit 15 includes: a first reversing unit 15A configured to reverse paper sheets transported in the short edge direction, in the long edge direction; and a second reversing unit 15B configured to reverse the paper sheets in the long edge direction. The reversing of paper sheets is described later.

The paper sheet sorting apparatus 2 further includes: four stackers 16A to 16D configured to sort and stack the paper sheets transported by the transport unit 13, in accordance with the kind of paper sheet; and two reject units 17A and 17B configured to stack rejected paper sheets that are not stacked in the stackers 16A to 16D and are not transported to the paper sheet bundling apparatus 3. The stackers 16A to 16D and the reject units 17A and 17B are each provided with a stacking wheel for stacking the paper sheets at a predetermined position in a stacking space, in a unit of one sheet.

Note that the kind of paper sheet includes seven denominations of 5 euros, 10 euros, 20 euros, 50 euros, 100 euros, 200 euros, and 500 euros in the case of euro banknotes, for example, and also includes: authenticity information for recognizing genuine notes and counterfeit notes; fitness information for recognizing fit notes and unfit notes; face/back information for recognizing face-up and face-down; orientation information for recognizing top and bottom; and the like. Moreover, the kind of paper sheet includes kind-of-banknote information for recognizing the kind of banknote of new version notes, old version notes, and the like for each denomination, in the case of other currencies.

Moreover, the paper sheet bundling apparatus 3 includes: a transport unit 13 configured to transport particular paper sheets from a transport path 18 inside of the paper sheet sorting apparatus 2 into this apparatus; three stacking units 21 that are placed at three stages in the top-bottom direction in this apparatus and are configured to sort and stack the paper sheets; and a bundling unit 22 that is placed below the three stacking units 21 and is configured to bundle, in the case where the number of paper sheets stacked in any of the stacking units 21 reaches a predetermined number of sheets, for example, 100 sheets, the 100 bundling target paper sheets using a bundling band.

The paper sheet bundling apparatus 3 further includes: a batch dispensing port 23 that is placed in the vicinity of the hopper unit 11 and is configured to dispense the paper sheets bundled by the bundling unit 22, that is, a batch of paper sheets to an operator; and a fraction returning port 24 that is placed in the vicinity of the stacking units 21 and is configured to dispense fractional paper sheets that are still stacked in the stacking units 21 at the end of a transaction, to the operator.

The paper sheet bundling apparatus 3 further includes: a before-bundling transport unit 25 configured to grip and transport the paper sheets stacked in the stacking units 21 to the bundling unit 22 or the fraction returning port 24; and an after-bundling transport unit 26 configured to grip and transport the bundling target paper sheets in the bundling unit 22 and transport the batch of paper sheets bundled by the bundling unit 22 to the batch dispensing port 23.

The before-bundling transport unit 25 grips the long edge side of 100 bundling target paper sheets of the bundling target paper sheets stacked in the stacking units 21, and transports the 100 bundling target paper sheets onto a bundling stage 22A in the bundling unit 22. At the end of a transaction, the before-bundling transport unit 25 grips stacked fractional paper sheets the number of which is less than 100, of the bundling target paper sheets stacked in the stacking units 21, and transports the fractional paper sheets to the fraction returning port 24. Note that the bundling stage 22A in the bundling unit 22 corresponds to a bundling work area of the bundling unit 22.

Moreover, the after-bundling transport unit 26 includes: a grip/transport unit 27 configured to move and adjust the gripped bundling target paper sheets after the before-bundling transport unit 25 transports the bundling target paper sheets onto the bundling stage 22A in the bundling unit 22, and grip and transport the batch of paper sheets bundled by the bundling unit 22; and a transport dispensing unit 28 configured to transport the batch of paper sheets gripped and transported by the grip/transport unit 27, to the batch dispensing port 23.

The grip/transport unit 27 grips the bundling target paper sheets at a work preparation position on the bundling stage 22A in the bundling unit 22, and then moves and adjusts the bundling target paper sheets so as to match a bundling position of the bundling target paper sheets with a bundling work position on the bundling stage 22A. Note that, when the bundling target paper sheets are placed at this bundling work position, it becomes possible for the bundling unit 22 to wind a bundling band around the bundling position of the bundling target paper sheets.

When the bundling unit 22 completes the bundling work of the bundling target paper sheets while the grip/transport unit 27 grips the bundling target paper sheets at the bundling work position on the bundling stage 22A, the grip/transport unit 27 transports the resultant batch of paper sheets into the transport dispensing unit 28.

The transport dispensing unit 28 includes: a lift part 61 configured to transport the batch of paper sheets gripped and transported by the grip/transport unit 27, to an upper portion of the paper sheet bundling apparatus 3; an ejection mechanism 62 configured to eject the batch of paper sheets that is transported to the upper portion of the paper sheet bundling apparatus 3 by the lift part 61, toward the batch dispensing port 23 (toward the apparatus front side); and a dispensing hold mechanism 63 configured to store therein the batch of paper sheets that is ejected toward the apparatus front side by the ejection mechanism 62 and dispense and hold the batch of paper sheets in the batch dispensing port 23.

The paper sheet processing apparatus 1 further includes the transport path 18 including: a transport path 18A that is connected to the hopper unit 11 and is placed at a position above the stackers 16A to 16D; a transport path 18B that is connected to the transport path 18A and is placed so as to bend back in the placement direction of the stackers 16A to 16D; and a transport path 18C that is connected to the transport path 18B and is connected to the stackers 16A to 16D and the stacking units 21. Note that it is assumed that the recognition unit 14 is placed on the transport path 18A and that the reversing unit is placed on the transport path 18B. Moreover, the transport path 18B is configured as a detachable unit connected to the transport path 18A and the transport path 18C of the paper sheet processing apparatus 1.

Moreover, detection sensors 19 are respectively placed in branched portions, joined portions, coupling portions between the apparatuses, and the like on the transport path 18, and respectively detect the entry and pass of each transported banknote in these portions.

A reject unit 20 is placed at the last end of the transport path 18C.

Moreover, diverters 13A are respectively placed in the branched portions on the transport path 18 in the paper sheet processing apparatus 1, and distribute the transported paper sheets transported on the transport path 18, into the stackers 16A to 16D, the stacking units 21, and the reject units 17A, 17B, and 20. When each detection sensor 19 detects the entry of the leading end of a transported paper sheet, a solenoid (not illustrated) is driven, whereby each diverter 13A distributes the transported paper sheet.

The first reversing unit 15A is capable of reversing paper sheets in the short edge direction (about an axis perpendicular to the transport direction of the paper sheets), on the basis of the orientation information and the face/back information that are the kind of paper sheet recognized by the recognition unit 14.

The second reversing unit 15B is capable of reversing paper sheets in the long edge direction (about an axis in the transport direction thereof), on the basis of the orientation information and the face/back information that are the kind of paper sheet recognized by the recognition unit 14. The diverter 13A provided before the second reversing unit 15B distributes the paper sheets into a reversing route or a non-reversing route.

The reversing route includes: a reversing member 15C that extends in the transport direction of the paper sheets and has a curved surface; a transport belt (not illustrated) that is stretched obliquely to the long edge direction of the reversing member 15A so as to partially follow the curved surface of the reversing member 15C; a drive motor (not illustrated) configured to drive the transport belt; and a guide part (not illustrated) configured to slidingly guide a surface of each paper sheet that is transported in the long edge direction of the reversing member 15C while being sandwiched between the transport belt and the reversing member 15C and being wound around the curved surface of the reversing member 15A.

In the state where the transport belt is driven by the drive motor, if a paper sheet is transported to the second reversing unit 15B, the paper sheet is sandwiched between the transport belt and the reversing member 15C, and moves in the transport direction while following movement of the transport belt. At this time, because the transport belt is stretched along the curved surface of the reversing member 15C obliquely to the long edge direction of the reversing member 15C, the paper sheet is transported while being wound around the curved surface, and is reversed while turning on its own axis. Moreover, at the time of reversing the paper sheet, the surface of the paper sheet is slidingly guided by the guide part, and this enables the paper sheet to be reliably reversed while the movement of the paper sheet is restricted during its transport.

Figure 3:
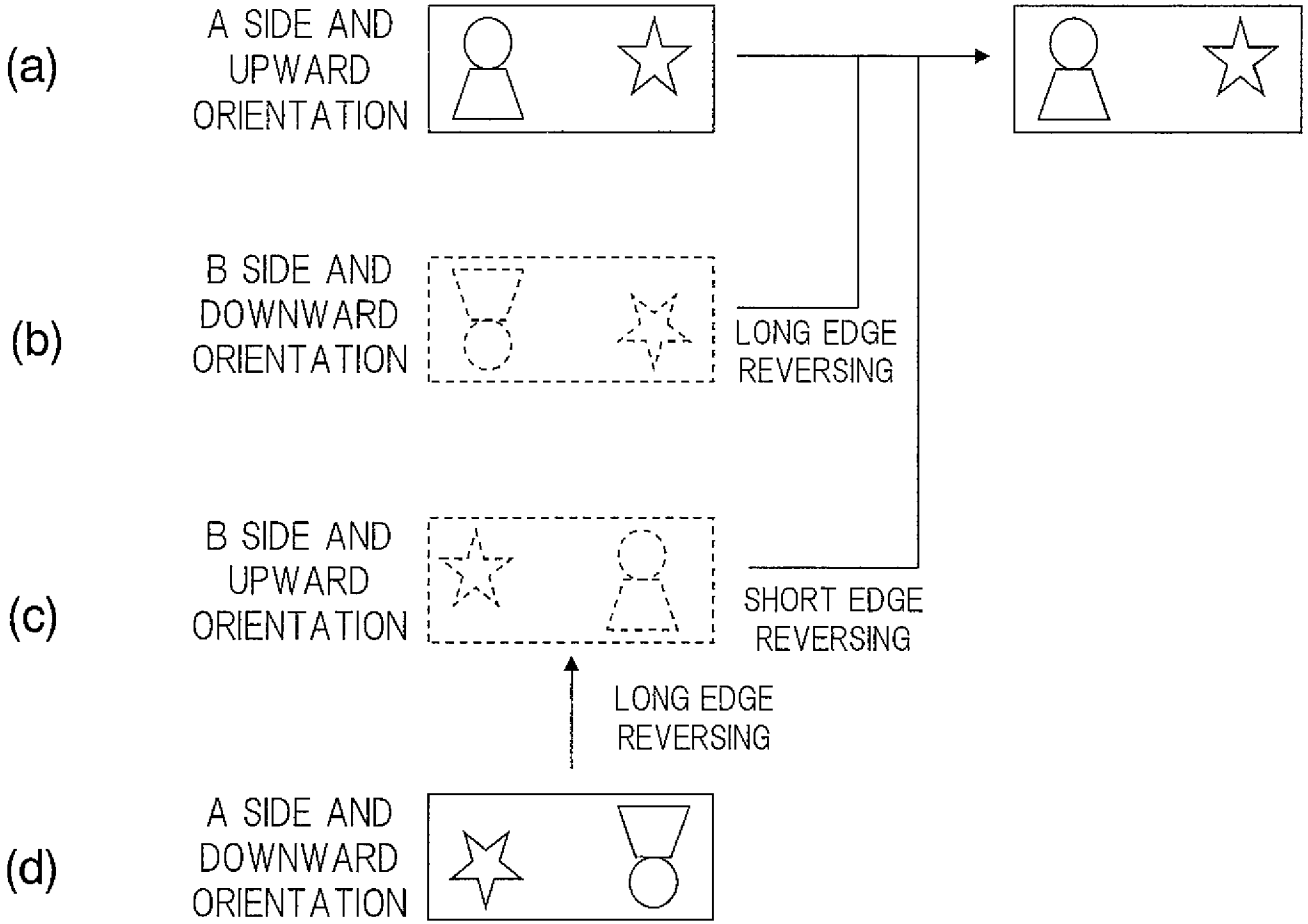
FIG. 3 are diagrams for describing a reversing process of paper sheets.

FIG. 3 are explanatory diagrams plainly illustrating a reversing process by the reversing unit 15.

In the case where the face/back information and the orientation information obtained by the recognition unit 14 indicate A side (face-up) and upward orientation (portrait-up) as illustrated in FIG. 3(*a*), the first reversing unit 15A and the second reversing unit 15B do not perform reversing, and transport the transported paper sheet to the third transport path 18C as it is.

Moreover, in the case where the face/back information and the orientation information obtained by the recognition unit 14 indicate B side (face-down) and downward orientation (portrait-down) as illustrated in FIG. 3(*b*), the first reversing unit 15A reverses the transported paper sheet in the long edge direction.

Moreover, in the case where the face/back information and the orientation information obtained by the recognition unit 14 indicate the B side and the upward orientation as illustrated in FIG. 3(*c*), the second reversing unit 15B reverses the transported paper sheet in the short edge direction.

Moreover, in the case where the face/back information and the orientation information obtained by the recognition unit 14 indicate the A side and the downward orientation as illustrated in FIG. 3(*d*), the first reversing unit 15A reverses the transported paper sheet in the long edge direction, and then, the second reversing unit 15B reverses the transported paper sheet in the short edge direction.

In this way, the first reversing unit 15A and the second reversing unit 15B enable the paper sheet to be reversed so as to face a particular side of any one of the face-up and the face-down and face a particular orientation of any one of the upward orientation and the downward orientation.

Moreover, for example, three cut-out parts are formed in a rear wall part of each stacking unit 21, and enable a hand part 41 (see FIG. 2) of the before-bundling transport unit 25 to enter a stacking space 31. A lower portion of the rear wall part has such an openable shutter configuration that enables the hand part 41 that has entered through the cut-out parts to grip the long edge side of the bundling target paper sheets in the stacking space 31 and to take the gripped bundling target paper sheets out of the stacking space 31.

Moreover, as illustrated in FIG. 2, the before-bundling transport unit 25 includes: a transport device 42 including the hand part 41 configured to collectively grip the long edge side of the bundling target paper sheets stacked in the stacking units 21; a horizontal movement mechanism 43 configured to move the transport device 42 in the front-back direction (horizontal direction); and a vertical movement mechanism 44 configured to move the transport device 42 in the top-bottom direction (vertical direction).

The vertical movement mechanism 44 includes: a guide shaft 44A that is vertically provided so as to extend from the lower end to the upper end of the paper sheet bundling apparatus 3; and a drive belt 44B configured to move the transport device 42 upward and downward while guiding the transport device 42 by means of the guide shaft 44A.

The transport device 42 in the before-bundling transport unit 25 includes the hand part 41 that is protrusible and retractable by a drive belt 43A in the horizontal movement mechanism 43. In the hand part 41, for example, three grip nails of its upper hand and three grip nails of its lower hand are opposed to each other, and the grip nails grip therebetween the long edge side of the bundling target banknotes stacked in the stacking units 21. Note that the lower hand is fixed, whereas the upper hand is movable upward and downward by the drive belt.

The transport device 42 grips the long edge side of the bundling target paper sheets between the respective grip nails of the upper hand and the lower hand, and transports the gripped bundling target paper sheets to the work preparation position on the bundling stage 22A in the bundling unit 22 or the fraction returning port 24.

In the state where the transport device 42 grips the long edge side of the 100 bundling target paper sheets, the before-bundling transport unit 25 transports and places the bundling target paper sheets onto the work preparation position on the bundling stage 22A in the bundling unit 22.

In the state where the transport device 42 grips the long edge side of the 100 bundling target paper sheets, the grip/transport unit 27 grips the short edge side of the 100 bundling target paper sheets at the work preparation position on the bundling stage 22A in the bundling unit 22. Note that, in response to such an operation of gripping the short edge side of the bundling target paper sheets by the grip/transport unit 27, the transport device 42 in the before-bundling transport unit 25 releases the grip of the long edge side of the bundling target paper sheets gripped by the transport device 42, and moves to a standby position thereof.

The grip/transport unit 27 includes a grip part 27A having upper and lower hands configured to collectively grip the short edge side of the paper sheets. The grip part 27A moves and adjusts the bundling target paper sheets in the long edge direction of the bundling target paper sheets from the work preparation position so as to match the bundling position of the bundling target paper sheets with the bundling work position on the bundling stage 22A.

In the state where the grip part 27A of the grip/transport unit 27 grips the short edge side of the bundling target paper sheets, the grip part 27A matches the bundling position of the bundling target paper sheets with the bundling work position on the bundling stage 22A, and the bundling unit 22 then executes bundling work for winding a bundling band around the bundling position of the bundling target paper sheets.

Moreover, the bundling unit 22 includes: a bundling band reel 501 configured to house a bundling band therein; a bundling band fixing part 502 configured to fix the leading end of the bundling band pulled out of the bundling band reel 501 to the bundling position of the bundling target paper sheets, in the state where the bundling position of the bundling target paper sheets is matched with the bundling work position; a whirling arm 503 configured to pull the bundling band fixed to the bundling target paper sheets out of the bundling band reel 501 and wind the pulled-out bundling band around the bundling position of the bundling target paper sheets; a cutter part 504 configured to cut the other end of the bundling band wound around the bundling position of the bundling target paper sheets; and a heater part 505 configured to thermally weld the other end of the bundling band cut by the cutter part 504. The bundling unit 22 bundles the bundling target paper sheets using the bundling band, to thereby make the batch of paper sheets.

Moreover, when the bundling unit 22 completes the bundling operation of the bundling target paper sheets, as illustrated in FIG. 2, the grip part 27A of the grip/transport unit 27 returns the resultant batch of paper sheets to the work preparation position, and transports the batch of paper sheets into the lift part 61 in the transport dispensing unit 28 through a paper sheet batch transporting path. Note that the grip/transport unit 27 releases the grip of the short edge side of the batch of paper sheets after transporting the batch of paper sheets into the lift part 61.

Moreover, as illustrated in FIG. 2, a stamp affixing unit 71 is driven above the paper sheet batch transporting path through which the batch of paper sheets is transported by the grip/transport unit 27, and the stamp affixing unit 71 affixes a stamp to the bundling band on the upper surface of the batch of paper sheets. A stamp driving mechanism 72 is placed to enable storage of the stamp affixing unit 71.

When the bundling unit 22 completes the making of the batch of paper sheets, the grip/transport unit 27 moves and places the batch of paper sheets to a standby position thereof below the stamp affixing unit 71. At this standby position, a position on the bundling band at which a stamp is desired to be affixed is located below the stamp affixing unit 71, and a stamp affixing surface of the stamp affixing unit 71 is placed parallel to the bundling band on the upper surface of the batch of paper sheets.

In the state where the batch of paper sheets is placed at this standby position, if the stamp affixing unit 71 is moved downward, the stamp affixing surface of the stamp affixing unit 71 comes into contact with the bundling band of the batch of paper sheets, whereby a stamp is affixed to the bundling band on the upper surface of the batch of paper sheets.

Upon completion of the stamp affixing, the stamp driving mechanism 72 moves the stamp affixing unit 71 upward from the banknote batch transporting path, and stores the stamp affixing unit 71 therein.

The grip/transport unit 27 transports the batch of paper sheets to which the stamp is affixed, into the lift part 61 in the transport dispensing unit 28.

The lift part 61 transports the batch of paper sheets gripped and transported by the grip part 27A of the grip/transport unit 27, to the ejection mechanism 62 in the upper portion of the paper sheet bundling apparatus 3.

The ejection mechanism 62 ejects and transports the batch of paper sheets that is transported to the upper portion of the paper sheet bundling apparatus 3 by the lift part 61, to the dispensing hold mechanism 63 on the batch dispensing port 23 side (on the apparatus front side).

The dispensing hold mechanism 63 includes: a paper sheet batch storing part 63A configured to store therein the batch of paper sheets ejected and transported by the ejection mechanism 62; and a paper sheet batch stage 63B on which the batch of paper sheets stored in the paper sheet batch storing part 63A is set. The dispensing hold mechanism 63 adjusts the height of the paper sheet batch stage 63B such that the batch of paper sheets ejected and transported by the ejection mechanism 62 is storable on top of the uppermost batch of paper sheets on the paper sheet batch stage 63B.

Figure 4:
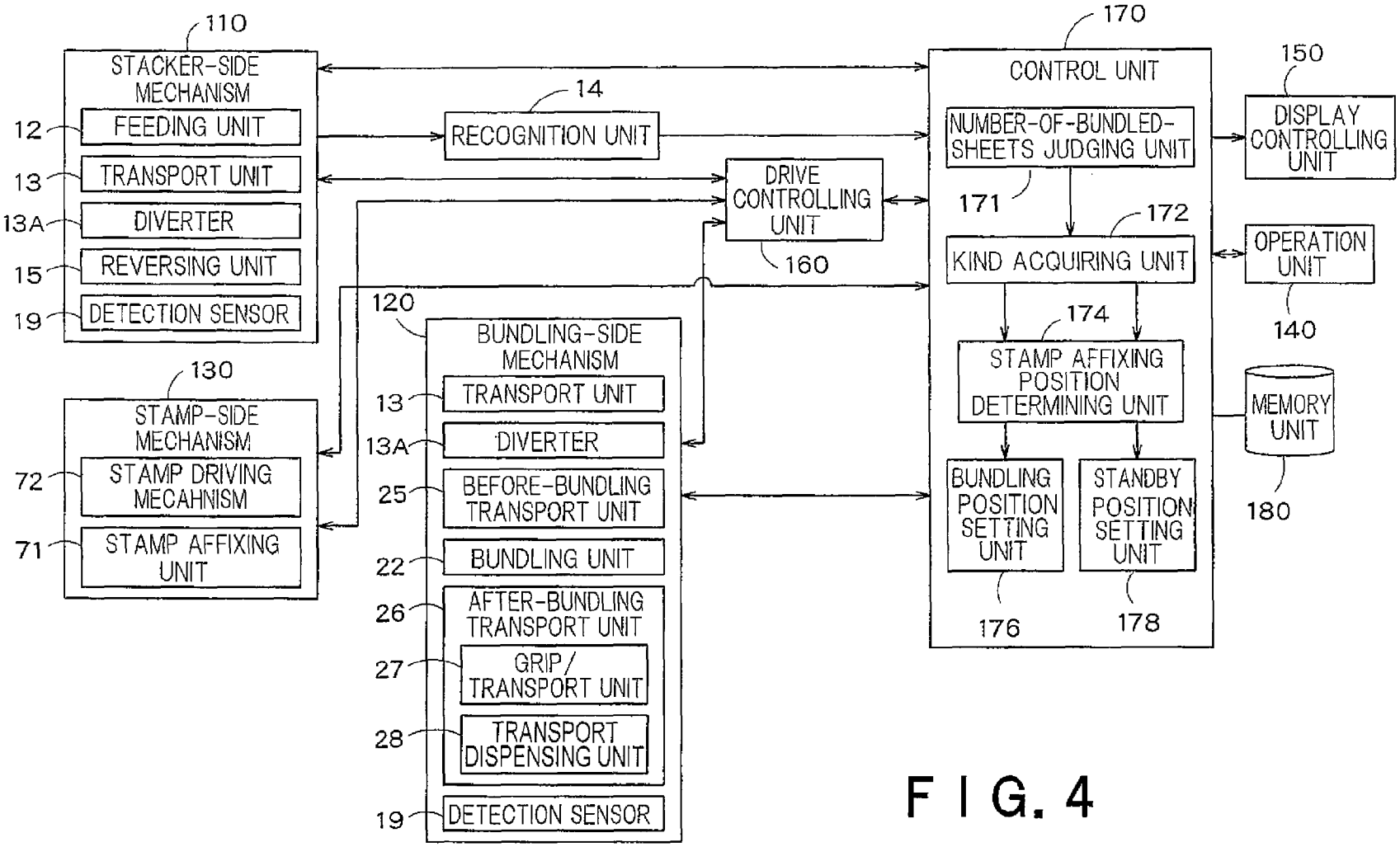
FIG. 4 is a block configuration diagram of the paper sheet processing apparatus according to the first embodiment.

FIG. 4 is a block diagram illustrating a schematic configuration of the inside of the paper sheet processing apparatus 1.

In addition to the recognition unit 14, the paper sheet processing apparatus 1 illustrated in FIG. 4 includes: a stacker-side mechanism 110 inside of the paper sheet sorting apparatus 2; a bundling-side mechanism 120 inside of the paper sheet bundling apparatus 3; a stamp-side mechanism 130 inside of the paper sheet bundling apparatus 3; an operation unit 140 configured to receive various commands; a display controlling unit 150 configured to display-control the display apparatus 4; a drive controlling unit 160 configured to drive-control the stacker-side mechanism 110, the bundling-side mechanism 120, and the stamp-side mechanism 130; a control unit 170 configured to control the entire paper sheet processing apparatus 1; and a memory unit 180 configured to store therein an association between the kind of paper sheet and a stamp affixing position on the bundling band of the batch of paper sheets.

The stacker-side mechanism 110 includes the feeding unit 12, the transport unit 13, the reversing unit 15, and the detection sensors 19 and the diverters 13A inside of the paper sheet sorting apparatus 2.

The bundling-side mechanism 120 includes the detection sensors 19, the transport unit 13, the diverters 13A, the bundling unit 22, the before-bundling transport unit 25, and the after-bundling transport unit 26 inside of the paper sheet bundling apparatus 3. Note that the after-bundling transport unit 26 includes the grip/transport unit 27 and the transport dispensing unit 28.

The stamp-side mechanism 130 includes the stamp affixing unit 71 and the stamp driving mechanism 72.

The control unit 170 sets, for example, the kind of the paper sheets stacked in each of the stackers 16A to 16D, the reject units 17A, 17B, and 20, and the stacking units 21. Note that the control unit 170 sets, for example, the 5-euro banknote to the stacker 16A, the 50-euro banknote to the stacker 16B, the 100-euro banknote to the stacker 16C, the 200-euro banknote to the stacker 16D, and the 500-euro banknote to the reject unit 17A, and the control unit 170 further sets, as initial settings, the 10-euro banknote to the stacking unit 21A, the 20-euro banknote to the stacking unit 21B, and the stacking unit 21C as a backup. Note that the reject unit 17A is also usable as a stacker in which rare banknotes such as the 500-euro banknote are stacked.

Moreover, on the basis of detection results by the detection sensor 19, the control unit 170 is capable of recognizing a trouble such as a banknote jam on the transport path.

Moreover, the control unit 170 includes: a number-of-bundled-sheets judging unit 171 configured to judge whether or not the number of bundling target paper sheets P stacked in any of the stacking units 21A to 21C reaches 100; a kind acquiring unit 172 configured to acquire the kind of the bundling target paper sheets P the number of which reaches 100, in the case where the number-of-bundled-sheets judging unit 171 judges that the number of the bundling target paper sheets P stacked in any of the stacking units 21A to 21C reaches 100; a stamp affixing position determining unit 174 configured to determine a stamp affixing position in accordance with the kind of the bundling target paper sheets P; a bundling position setting unit 176 configured to obtain and set a bundling position from the stamp affixing position determined by the stamp affixing position determining unit 174; and a standby position setting unit 178 configured to obtain and set such a standby position of the batch of paper sheets that a stamp is affixed to the stamp affixing position determined by the stamp affixing position determining unit 174.

When the kind acquiring unit 172 acquires the kind of the bundling target paper sheets, the stamp affixing position determining unit 174 determines the stamp affixing position on the bundling band, with reference to the association between the kind of paper sheet and the stamp affixing position on the bundling band of the batch of paper sheets or the paper sheet, the association being stored in the memory unit 180.

In the case where the association stored in the memory unit 180 is the association between the kind of paper sheet and the stamp affixing position on the bundling band, the stamp affixing position at which partial missing of an affixed stamp does not occur is stored in a range of the stamp affixing surface of the bundling band wound around a predetermined position. Accordingly, in this case, the bundling position is not adjusted, and, after the bundling, the position of the batch of paper sheets with respect to the stamp is adjusted in the bundling direction, whereby the stamp affixing position on the bundling band is changed. Moreover, fine adjustment in the width direction of the bundling band is also possible in a range in which a stamp impression falls within the bundling band.

Meanwhile, in the case where the association stored in the memory unit 180 is the association between the kind of paper sheet and the stamp affixing position on the paper sheet, the stamp affixing position at which partial missing of an affixed stamp does not occur is stored in a range of the entire surface of the paper sheet. Accordingly, in this case, both the bundling position and the stamp affixing position on the bundling band are adjusted. Specifically, the bundling position is adjusted for bundling such that a stamp impression falls within the bundling band when a stamp is affixed at the stamp affixing position determined by the stamp affixing position determining unit 174. After the bundling, the position of the batch of paper sheets with respect to the stamp is adjusted in the bundling direction, whereby the stamp affixing position on the bundling band is changed. In this way, it is possible to affix the stamp at the stamp affixing position on the paper sheet that is determined by the stamp affixing position determining unit 174.

Hereinafter, an embodiment of the latter case is described.

The bundling position setting unit 176 obtains a bundling position in the paper sheet long edge direction such that the bundling band is placed at the stamp affixing position determined by the stamp affixing position determining unit 174, and sets the obtained bundling position to the drive controlling unit 160.

The standby position setting unit 178 obtains such a standby position of the batch of paper sheets that the stamp affixing position determined by the stamp affixing position determining unit 174 is located below (immediately below) the stamp affixing unit 71, and sets the obtained standby position to the drive controlling unit 160.

As a result, the drive controlling unit 160 drive-controls the grip part 27A of the grip/transport unit 27 to match the bundling position of the bundling target paper sheets with the bundling work position on the bundling stage 22A in the bundling unit 22, on the basis of the bundling position set by the bundling position setting unit 176.

Moreover, the drive controlling unit 160 moves and places the batch of paper sheets on the basis of the standby position of the batch of paper sheets set by the standby position setting unit 178, and opposes the stamp affixing surface of the stamp affixing unit 71 to the bundling band on the upper surface of the batch of paper sheets. The drive controlling unit 160 moves the stamp affixing unit 71 downward at this position, to thereby enable a stamp to be affixed to the bundling band at the stamp affixing position determined by the stamp affixing position determining unit 174.

Moreover, the drive controlling unit 160 acquires the kind of paper sheet recognized by the recognition unit 14. In the case where the kind of the paper sheet transported on the transport path 18 coincides with any of the kinds set to the stackers 16A to 16D and the stacking units 21A to 21C, the drive controlling unit 160 drive-controls the transport unit 13 and the diverters 12A to sort and stack this transported paper sheet into a corresponding one of the stackers 16A to 16D and the stacking units 21A to 21C.

Moreover, in the case where the paper sheet transported on the transport path 18 is a paper sheet other than the paper sheets set to the stackers 16A to 16D and the stacking units 21A to 21C or a paper sheet that is not recognizable due to a transport error and the like, the drive controlling unit 160 drive-controls the transport unit 13 and the diverters 13A to transport this transported paper sheet to the reject unit 17A. Note that the kind of paper sheet is settable to the reject unit 17A, and hence paper sheets of the set kind may be stacked in the reject unit 17A.

For example, in the case where the 10-euro banknote is set to the stacking unit 21A, where the 20-euro banknote is set to the stacking unit 21B, and where the stacking unit 21C is set as a backup stacking unit, if the number of bundling target paper sheets stacked in the stacking unit 21A reaches 100, the drive controlling unit 160 drive-controls the before-bundling transport unit 25 to pull the stacked bundling target paper sheets out of the stacking unit 21A by means of the hand part 41 in the transport device 42 of the before-bundling transport unit 25.

In the case where the number of 10-euro banknotes stacked in the stacking unit 21A reaches 100, the control unit 170 sets such switching that 10-euro banknotes are stacked in the backup stacking unit 21C. Moreover, the control unit 170 causes the hand part 41 in the transport device 42 to pull out the 10-euro banknotes the number of which reaches 100, to thereby enable banknotes to be stacked again in the stacking unit 21A, and the control unit 170 switchingly sets the stacking unit 21A as a backup stacking unit.

Figure 5:
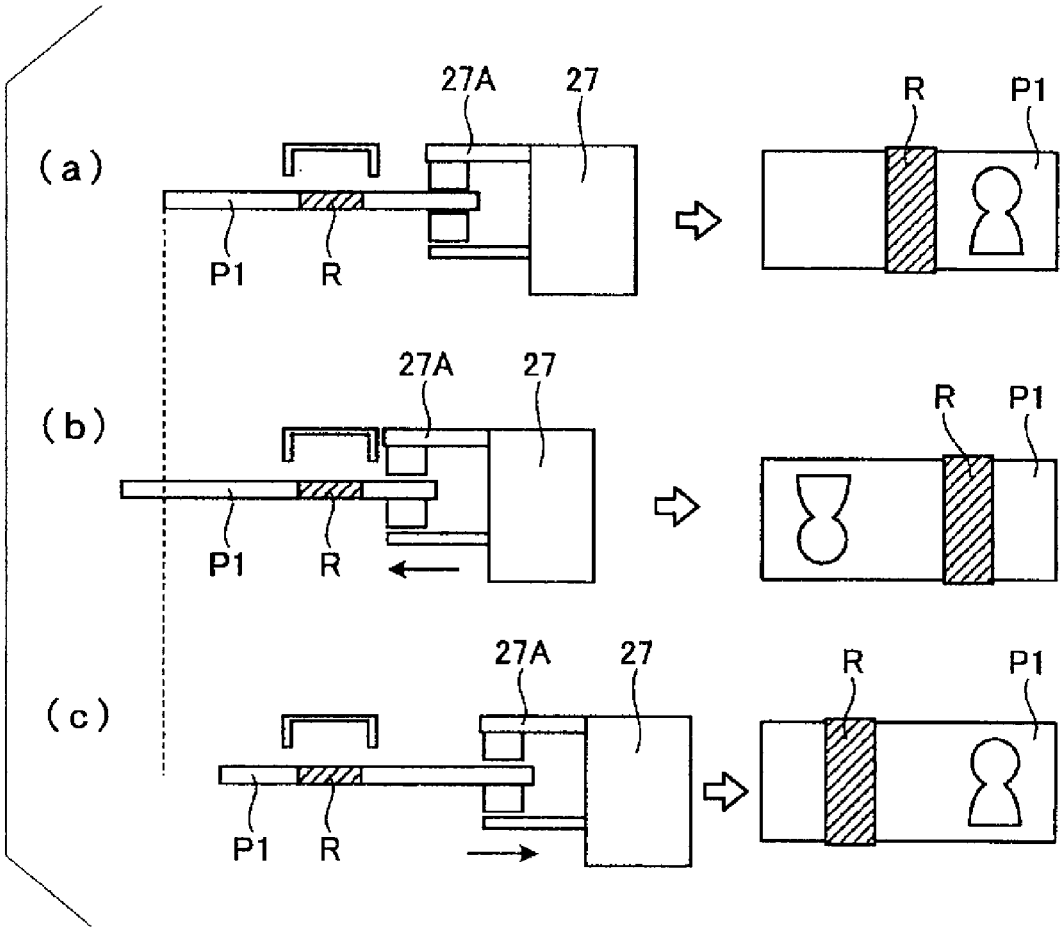
FIG. 5 are diagrams for describing a bundling process of paper sheets.

FIG. 5 are explanatory diagrams plainly illustrating operation transition of the grip/transport unit 27 above the bundling stage 22A.

For example, in the case where the bundling position of the bundling target paper sheets P gripped by the grip part 27A is a central portion of the bundling target paper sheets P as illustrated in FIG. 5(*a*), the grip part 27A matches the bundling work position with the central portion that is the bundling position of the bundling target paper sheets P. Then, the bundling unit 22 winds a bundling band R around the central portion of the bundling target paper sheets P, and bundles the bundling target paper sheets P, whereby a batch of paper sheets P1 is made.

Moreover, for example, in the case where the bundling position of the bundling target paper sheets P gripped by the grip part 27A is a grip-side end portion of the bundling target paper sheets P as illustrated in FIG. 5(*b*), the grip part 27A matches the bundling work position with the grip-side end portion. Then, the bundling unit 22 winds the bundling band R around the grip-side end portion of the bundling target paper sheets P, and bundles the bundling target paper sheets P, whereby the batch of banknotes P1 is made.

Moreover, in the case where the bundling position of the bundling target paper sheets P gripped by the grip part 27A is an end portion of the bundling target paper sheets P that is opposite to the grip side as illustrated in FIG. 5(*c*), the grip part 27A matches the bundling work position with the end portion opposite to the grip side. Then, the bundling unit 22 winds the bundling band R around the end portion of the bundling target paper sheets P that is opposite to the grip side, and bundles the bundling target paper sheets P, whereby the batch of paper sheets P1 is made.

Figure 6:
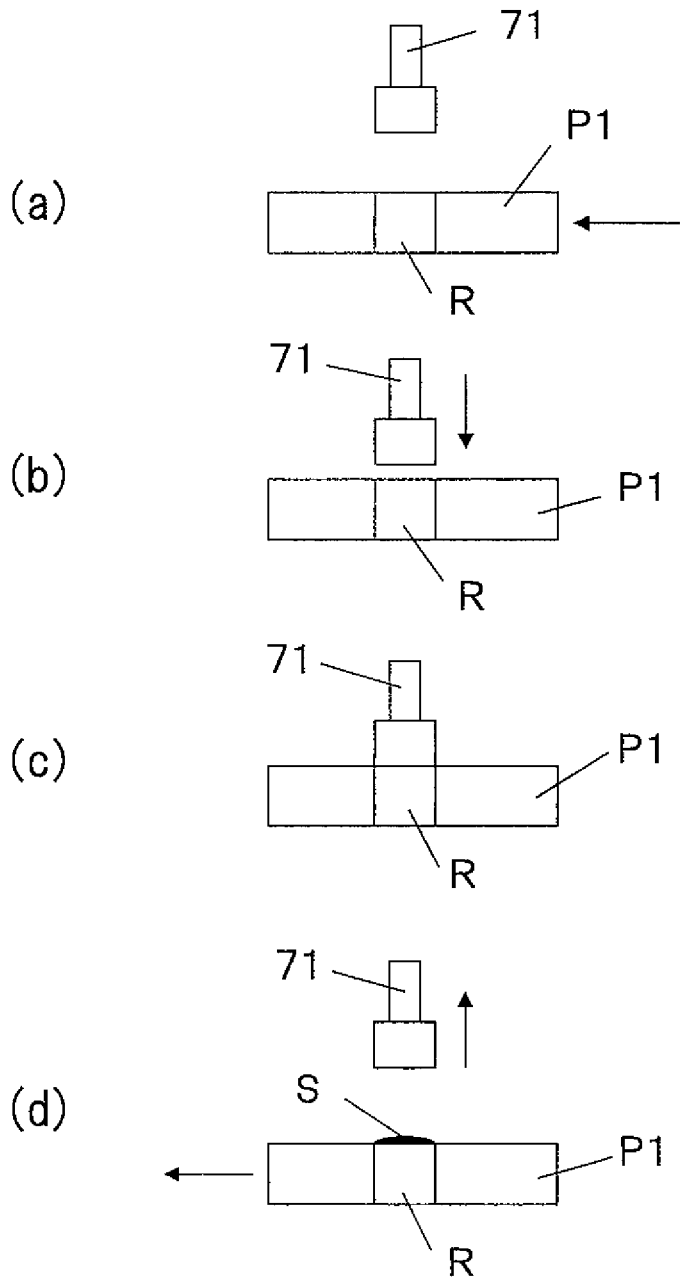
FIG. 6 are diagrams for describing a stamp affixing process of paper sheets.

FIG. 6 are explanatory diagrams plainly illustrating operation transition of the stamp-side mechanism 130.

On the basis of a standby position corresponding to the stamp affixing position, the stamp-side mechanism 130 drives the grip part 27A in the long edge direction and the short edge direction of the batch of paper sheets P1 to move and place the batch of paper sheets P1 such that the bundling band R of the batch of paper sheets P1 is placed parallel to the stamp affixing surface of the stamp affixing unit 71 (see FIG. 6(*a*)). At the resultant position, the stamp-side mechanism 130 moves the stamp affixing unit 71 downward (see FIG. 6(*b*)). This brings the stamp affixing unit 71 into contact with the bundling band R on the upper surface of the batch of paper sheets P1, and a stamp S is affixed to the bundling band R (see FIG. 6(*c*)). After that, the stamp-side mechanism 130 moves the stamp affixing unit 71 upward, and stores the stamp affixing unit 71 into the stamp driving mechanism 72 (see FIG. 6(*d*)).

FIG. 7 is a diagram illustrating an example of the association between the kind of paper sheet and the stamp affixing position on the bundling band of the batch of paper sheets, the association being stored in the memory unit 180. FIG. 7 illustrates how far the stamp affixing position is in the short edge direction and the long edge direction from a reference point, assuming that any one point of the four corners of the bundling target paper sheets is defined as the reference point, for example. An arbitrary method is adopted to express how far the stamp affixing position is, and, for example, the number of motor pulses of the grip/transport unit 27 is adopted.

For example, in the example illustrated in FIG. 7, in the case where the bundling target paper sheets are 10-euro banknotes in face-up and upward orientation (portrait-up), a position away from the reference point by 15 pulses in the short edge direction and 30 pulses in the long edge direction is set to the stamp affixing position. The bundling unit 22 winds the bundling band around a portion away from the reference point by 30 pulses in the long edge direction.

Then, the grip/transport unit 27 moves the batch of paper sheets to the standby position such that the position thereon away from the reference point by 15 pulses in the short edge direction and 30 pulses in the long edge direction is located below the stamp affixing unit 71. Then, the stamp affixing unit 71 moves downward to come into contact with the bundling band, and this enables a stamp to be affixed thereto.

The stamp affixing position stored in the memory unit 180 is set in consideration of irregularities that occur on the surface due to ink, security threads, and the like of the paper sheets, and is a position at which the surface is (substantially) flat when 100 paper sheets are put on top of each other. Hence, at the time of affixing a stamp to the bundling band, it is possible to prevent occurrence of partial missing of the affixed stamp.

FIG. 7 illustrates an example of the association between the face/back, orientation, and denomination of each banknote and the stamp affixing position on the bundling band of the batch of paper sheets, in the case where the bundling target paper sheets are euro banknotes. The memory unit 180 is capable of storing therein a similar association for currencies other than euros. Moreover, preferably, the memory unit 180 stores therein an association between various kinds and the stamp affixing position, and examples of the various kinds include not only face/back, orientation, and denominations but also fitness, newness, and combinations thereof.

Figure 8:
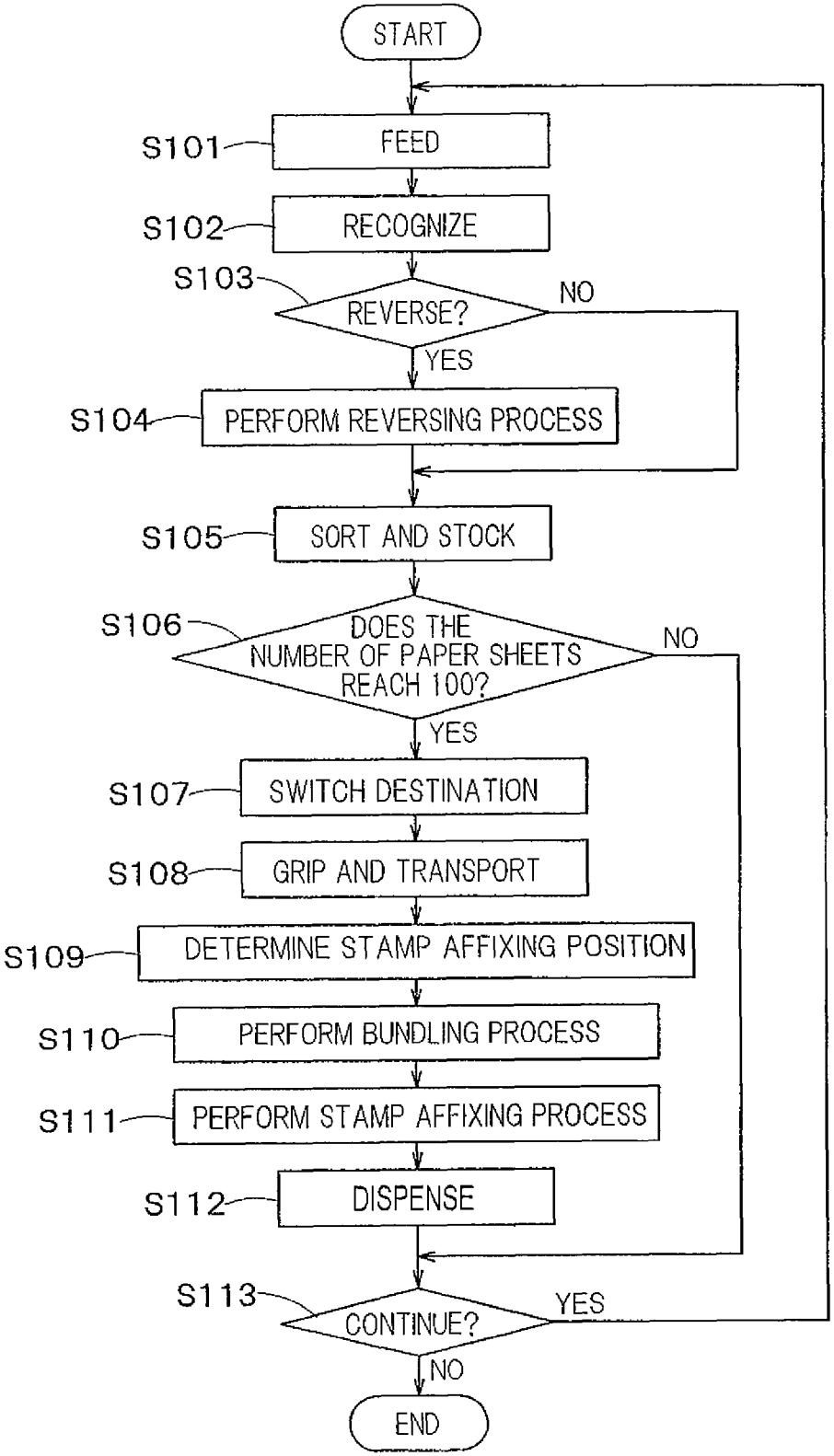
FIG. 8 is a flow chart for describing a method of processing paper sheets according to the first embodiment.

Next, an operation of the paper sheet processing apparatus 1 is described with reference to a flow chart in FIG. 8. Note that it is assumed that the kinds of the paper sheets stacked in the stackers 16A to 16D and the stacking units 21A to 21C and the kinds of the paper sheets stacked in the reject units 17A, 17B, and 20 are set in advance. Moreover, any one of the stacking units 21A to 21C is set as a backup stacking unit.

(Step S101) The feeding unit 12 feeds paper sheets put in the hopper unit 11, in a unit of one sheet.

(Step S102) The recognition unit 14 recognizes the kind of each paper sheet fed by the feeding unit 12. Examples of the kind of paper sheet include currencies, denominations, face/back, orientation, fitness, the kind of banknote (newness), and the like.

(Step S103) On the basis of the face/back information and the orientation information of the recognition results obtained by the recognition unit 14, it is judged whether or not a reversing process of the paper sheet is performed. If the reversing process is performed, the processing goes to Step S104. If not, the processing goes to Step S105.

For example, it is necessary to arrange the paper sheets stacked in each of the stackers 16A to 16D and the stacking units 21A to 21C in the same face/back and orientation. In the case where the recognized paper sheet is not in predetermined face/back and orientation, the reversing process is performed.

(Step S104) The first reversing unit 15A and/or the second reversing unit 15B reverses the face/back of the paper sheet.

(Step S105) The paper sheet is transported and stacked into any of the stackers 16A to 16D and the stacking units 21A to 21C. Note that a rejected paper sheet is transported and stacked into any of the reject units 17A, 17B, and 20.

(Step S106) If the number of paper sheets stacked in any of the stacking units 21A to 21C reaches 100, the processing goes to Step S107. If not, the processing goes to Step S113.

(Step S107) The destination of paper sheets of the kind that is set to any of the stacking units 21A to 21C in which the number of stacked paper sheets reaches 100 is switched to any of the backup stacking units 21A to 21C.

(Step S108) The before-bundling transport unit 25 pulls the paper sheets out of any of the stacking units 21A to 21C in which the number of stacked paper sheets reaches 100, and transports the paper sheets to the bundling unit 22.

(Step S109) The control unit 170 determines the stamp affixing position of the stacked paper sheets the number of which reaches 100, with reference to the association between the kind of paper sheet and the stamp affixing position, the association being stored in the memory unit 180. Moreover, the control unit 170 determines the bundling position on the basis of the stamp affixing position.

(Step S110) The bundling unit 22 performs a bundling process by winding the bundling band at the bundling position determined in Step S109 around the paper sheets transported by the before-bundling transport unit 25.

(Step S111) The grip/transport unit 27 transports the batch of paper sheets that has been subjected to the bundling process, to below the stamp affixing unit 71. The grip/transport unit 27 transports the batch of paper sheets such that the stamp affixing position determined in Step S109 is located immediately below the stamp affixing unit 71.

After the batch of paper sheets is transported to below the stamp affixing unit 71, the drive controlling unit 160 moves the stamp affixing unit 71 downward, to thereby affix a stamp to the bundling band.

(Step S112) The grip/transport unit 27 transports the batch of paper sheets to which the stamp is affixed, into the lift part 61. The lift part 61 transports the batch of paper sheets to the ejection mechanism 62 in the upper portion of the paper sheet bundling apparatus 3. The ejection mechanism 62 ejects and transports the batch of paper sheets to the dispensing hold mechanism 63 on the batch dispensing port 23 side (on the apparatus front side).

(Step S113) If there is still a paper sheet in the hopper unit 11, the processing returns to Step S101 to be continued.

Meanwhile, if there is not a paper sheet in the hopper unit 11 anymore, the processing is ended. In this case, the before-bundling transport unit 25 may transport fractional paper sheets stacked in the stacking units 21A to 21C to the fraction returning port 24.

In this way, according to the present embodiment, in consideration of irregularities that are caused on the surface by putting a plurality of paper sheets arranged in a predetermined same orientation on top of each other, it is possible to affix a stamp to a position at which the surface is (substantially) flat. Hence, at the time of affixing a stamp to the bundling band, it is possible to prevent occurrence of partial missing of the affixed stamp and easily read the affixed stamp.

In the above-mentioned embodiment, the paper sheet processing apparatus 1 is provided with the first reversing unit 15A and the second reversing unit 15B. Hence, in no matter what face/back and orientation paper sheets taken in the apparatus are, it is possible to arrange the paper sheets in the same face/back and orientation as illustrated in FIG. 3. Alternatively, the paper sheet processing apparatus 1 may be provided with only any one of the first reversing unit 15A and the second reversing unit 15B.

For example, it is assumed that only the second reversing unit 15B is provided and that only reversing in the short edge direction of a paper sheet is performed. In the case of the A side (face-up) and the upward orientation (portrait-up) as illustrated in FIG. 9(*a*), the paper sheet is not reversed by the second reversing unit 15B, and is transported to the third transport path 18C as it is.

Moreover, in the case of the B side (face-down) and the downward orientation (portrait-down) as illustrated in FIG.

9(*b*), the transported paper sheet is reversed in the short edge direction by the second reversing unit 15B.

Figure 9:
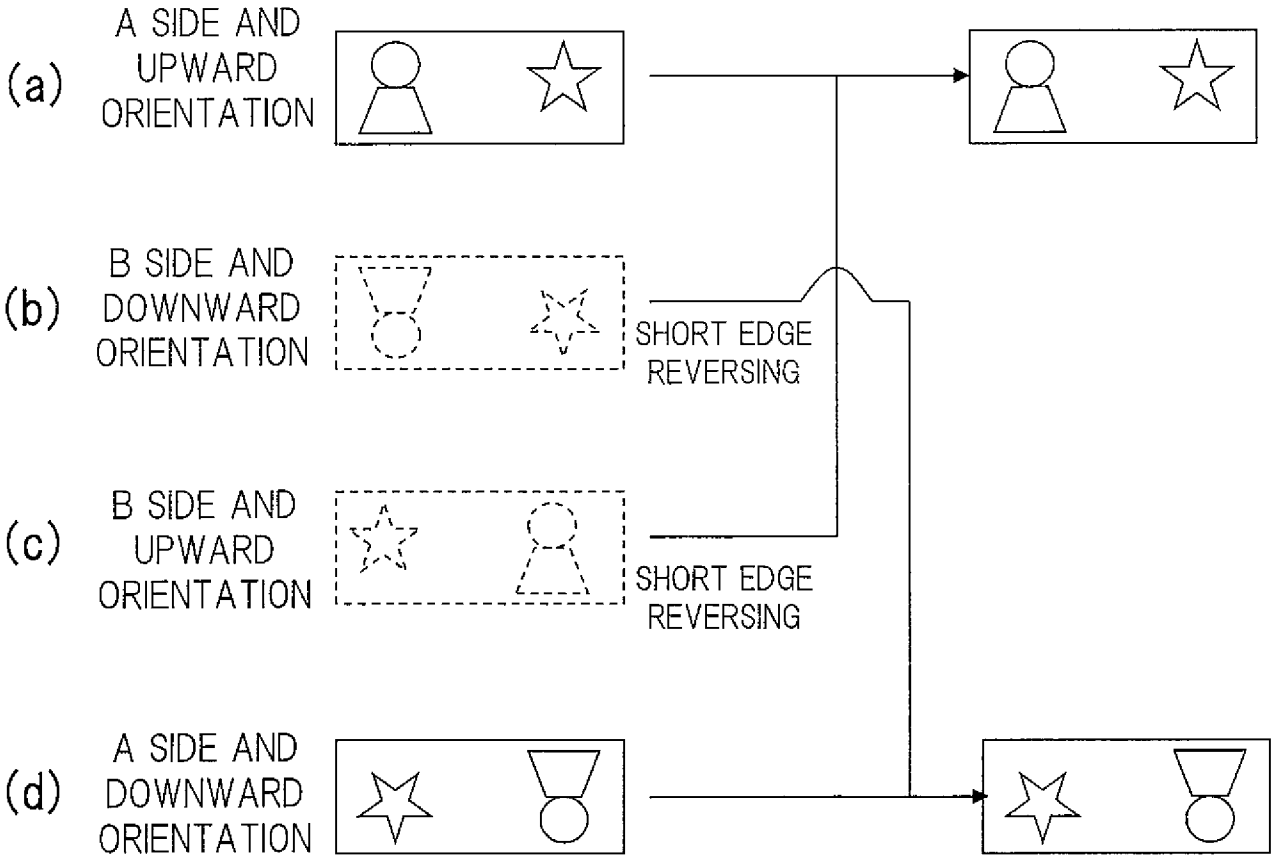
FIG. 9 are diagrams for describing a reversing process of paper sheets.

Moreover, in the case of the B side and the upward orientation as illustrated in FIG. 9(*c*), the transported paper sheet is reversed in the short edge direction by the second reversing unit 15B.

Moreover, in the case of the A side and the downward orientation as illustrated in FIG. 9(*d*), the paper sheet is not reversed by the second reversing unit 15B, and is transported to the third transport path 18C as it is.

This makes it possible to sort paper sheets into: the A side and the upward orientation; and the A side and the downward orientation. The paper sheets in the A side and the upward orientation are stacked in the stacking unit 21A, and the paper sheets in the A side and the downward orientation are stacked in the stacking unit 21B. This enables the paper sheets to be sorted so as to be arranged in the same face/back and orientation.

Moreover, in order to sort and bundle the paper sheets under other conditions such as denominations and fitness, the paper sheets in the A side and the upward orientation and the paper sheets in the A side and the downward orientation may be stacked in the same stacking unit 21A. When the number of the paper sheets stacked in the stacking unit 21A reaches 100, the bundling target paper sheets are formed of two kinds of paper sheets, that is, the paper sheets in the A side and the upward orientation and the paper sheets in the A side and the downward orientation.

In such a case, the stamp affixing position determining unit 174 obtains the breakdown of the 100 bundling target paper sheets, that is, the number of the paper sheets in the A side and the upward orientation and the number of the paper sheets in the A side and the downward orientation, from the recognition results obtained by the recognition unit 14. Then, the stamp affixing position determining unit 174 determines the stamp affixing position on the basis of the kind of the paper sheets the number of which is larger. For example, when the number of the paper sheets in the A side and the upward orientation is 80 while the number of the paper sheets in the A side and the downward orientation is 20, the control unit 170 acquires the stamp affixing position corresponding to the A side and the upward orientation, from the association between the kind of paper sheet and the stamp affixing position on the bundling band of the batch of paper sheets, the association being stored in the memory unit 180, and the control unit 170 sets the acquired stamp affixing position to the drive controlling unit 160.

Alternatively, the control unit 170 may acquire both the stamp affixing position corresponding to the A side and the upward orientation and the stamp affixing position corresponding to the A side and the downward orientation, from the association between the kind of paper sheet and the stamp affixing position on the bundling band of the batch of paper sheets, the association being stored in the memory unit 180. Then, the control unit 170 may determine the stamp affixing position from the ratio of the number of the paper sheets in the A side and the upward orientation to the number of the paper sheets in the A side and the downward orientation. For example, when the number of the paper sheets in the A side and the upward orientation is 50 while the number of the paper sheets in the A side and the downward orientation is 50, the control unit 170 determines, as the stamp affixing position, a middle point between the stamp affixing position corresponding to the A side and the upward orientation and the stamp affixing position corresponding to the A side and the downward orientation.

According to similar methods, the control unit 170 can determine the stamp affixing position from the ratio of fit notes to unfit notes, the ratio of new version notes to old version notes, or the ratio of face-up notes to face-down notes, the notes being included in the bundling target paper sheets, or from an orientation-based ratio thereof or a combination thereof.

In the case where the bundling target paper sheets mixedly include a plurality of kinds of paper sheets as described above, the stamp affixing position is set to the stamp affixing position corresponding to the kind of the paper sheets the number of which is largest, or is obtained from the stamp affixing positions corresponding to the respective kinds of the paper sheets and the ratio of the numbers thereof. This enables a stamp to be affixed to a flat portion. Accordingly, at the time of affixing a stamp to the bundling band, it is possible to prevent occurrence of partial missing of the affixed stamp.

In the above-mentioned embodiment, the bundling position of the bundling band may be fixed. In this case, the stamp affixing position determining unit 174 changes the stamp affixing position only along the short edge direction of the paper sheets, in accordance with the kind of bundling target paper sheet.

In the above-mentioned embodiment, the batch of paper sheets is moved such that the stamp affixing position is located below the stamp affixing unit 71. Alternatively, the stamp affixing unit 71 may move so as to be located above the stamp affixing position.

Second Embodiment

In the first embodiment, the memory unit 180 stores therein the association between the kind of paper sheet and the stamp affixing position on the bundling band of the batch of paper sheets or the paper sheet, but may store therein an association between the kind of paper sheet and a stamp affixing impossible position on the bundling band or the paper sheet. The stamp affixing impossible position refers to a region in which, when a plurality of paper sheets are put on top of each other, irregularities occur on the surface, and partial missing of an affixed stamp is likely to occur.

Description is given of two methods in which the stamp affixing position determining unit 174 determines the stamp affixing position with reference to the association between the kind of paper sheet and the stamp affixing impossible position.

According to the first method, one stamp affixing position is initially set, and is stored in the memory unit 180 or the like. The initially set stamp affixing position is, for example, the center of the bundling band or the paper sheet. If the number of the paper sheets stacked in any of the stacking units 21A to 21C reaches 100, the stamp affixing position determining unit 174 acquires the stamp affixing impossible position from the memory unit 180 on the basis of the kind of bundling target paper sheet, and judges whether or not initial setting of the stamp affixing position is included in this stamp affixing impossible position.

In the case where the initial setting of the stamp affixing position is not included in this stamp affixing impossible position, the bundling process and the stamp affixing process are performed without any change in the initial setting. Meanwhile, in the case where the initial setting of the stamp affixing position is included in this stamp affixing impossible position, the stamp affixing position determining unit 174 determines, as the stamp affixing position, a position that is not included in the stamp affixing impossible position and is shortest in moving distance from the initial setting.

According to the second method, a plurality of stamp affixing positions are initially set with the order of priority, and are stored in the memory unit 180 or the like. The initially set stamp affixing positions are, for example, the center of the paper sheet, a position away from the center by 10 mm upward in the short edge direction, a position away from the center by 10 mm downward in the short edge direction, a position away from the center by 10 mm rightward in the long edge direction, a position away from the center by 10 mm leftward in the long edge direction, a position away from the center by 20 mm upward in the short edge direction, . . . , in descending order of priority.

If the number of the paper sheets stacked in any of the stacking units 21A to 21C reaches 100, the stamp affixing position determining unit 174 acquires the stamp affixing impossible position from the memory unit 180 on the basis of the kind of bundling target paper sheet. Then, the stamp affixing position determining unit 174 determines, as the stamp affixing position, a position that is not included in this stamp affixing impossible position and has the highest priority, from among the plurality of initially set stamp affixing positions.

If the bundling process and the stamp affixing process are performed on the basis of the stamp affixing position thus determined, similarly, at the time of affixing a stamp to the bundling band, it is possible to prevent occurrence of partial missing of the affixed stamp and easily read the affixed stamp.

The memory unit 180 may store therein both the association between the kind of paper sheet and the stamp affixing position and the association between the kind of paper sheet and the stamp affixing impossible position.

In this case, first, as described above in the first embodiment, the stamp affixing position determining unit 174 tentatively determines the stamp affixing position of the bundling target paper sheets, with reference to the association between the kind of paper sheet and the stamp affixing position on the bundling band of the batch of paper sheets.

Next, as described in the present embodiment, the stamp affixing position determining unit 174 obtains the stamp affixing impossible position of the bundling target paper sheets, with reference to the association between the kind of paper sheet and the stamp affixing impossible position on the bundling band.

Then, the stamp affixing position determining unit 174 judges whether or not the tentatively determined stamp affixing position is included in this stamp affixing impossible position. In the case where the tentatively determined stamp affixing position is included therein, the stamp affixing position determining unit 174 determines, as the stamp affixing position, a position that is not included in the stamp affixing impossible position and is shortest in moving distance from the tentatively determined stamp affixing position.

Third Embodiment

Figure 10:
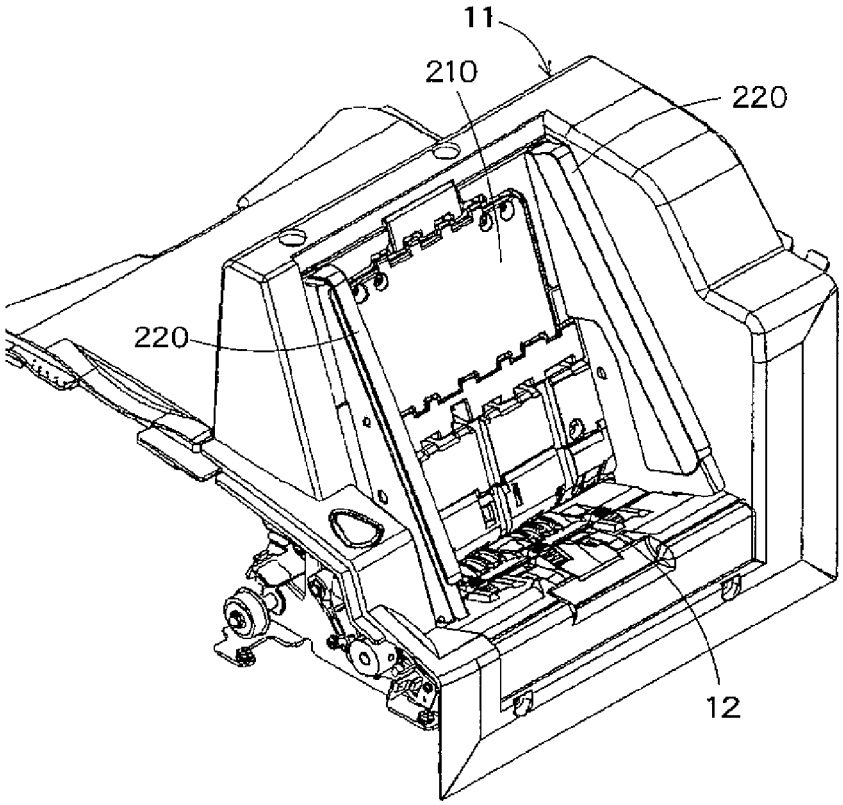
FIG. 10 is an external perspective view of a hopper unit.
Figure 11:
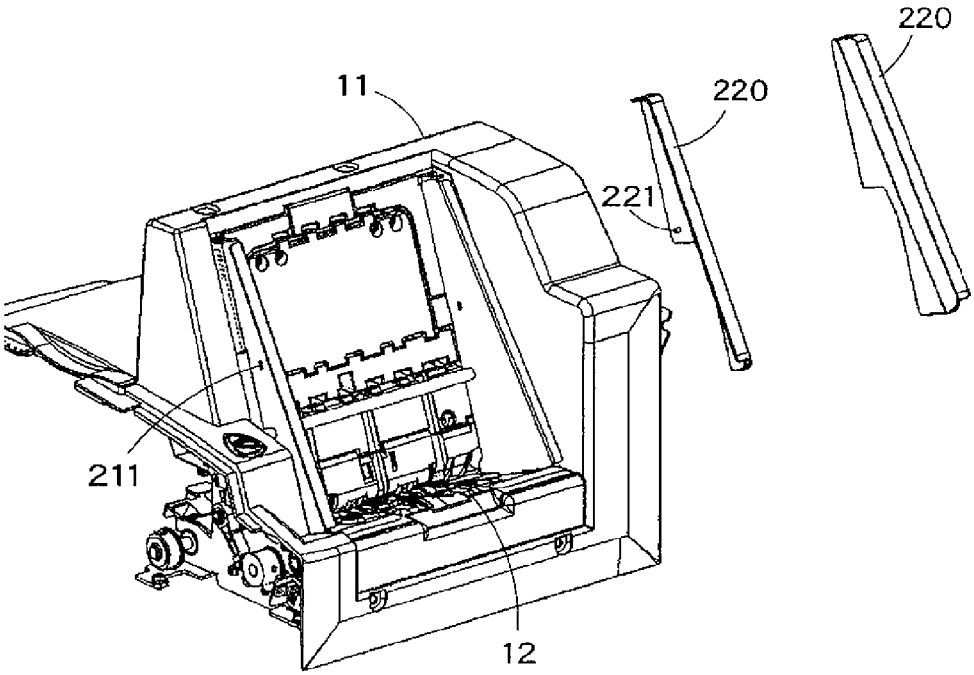
FIG. 11 is an external perspective view of the hopper unit.

FIG. 10 and FIG. 11 are external perspective views of the hopper unit 11 of the paper sheet processing apparatus 1 according to the first embodiment.

As illustrated in FIG. 10 and FIG. 11, width restricting members 220 are respectively provided in both side portions of the hopper unit 11, and the width restricting members 220 restrict the width of a suspension region 210 in which paper sheets are temporarily suspended in the hopper unit 11. Each width restricting member 220 is made of, for example, a resin to which a magnet (not illustrated) is attached, and is provided with a positioning pin 221 as illustrated in FIG. 11. Both the side portions of the hopper unit 11 are made of stainless steel, and are each provided with a positioning hole 211. The width restricting members 220 are respectively positioned by the pins 221 and the holes 211, and are fixed to both the side portions of the hopper unit 11 by magnetic force of the magnet as illustrated in FIG. 10.

If the width restricting members 220 thus configured are attached to the hopper unit 11, this enables small-sized paper sheets to be brought together to the center before being fed by the feeding unit 12. Hence, in the case where the small-sized paper sheets are bundled, it is possible to prevent edges of the paper sheets from protruding.

Figure 12:
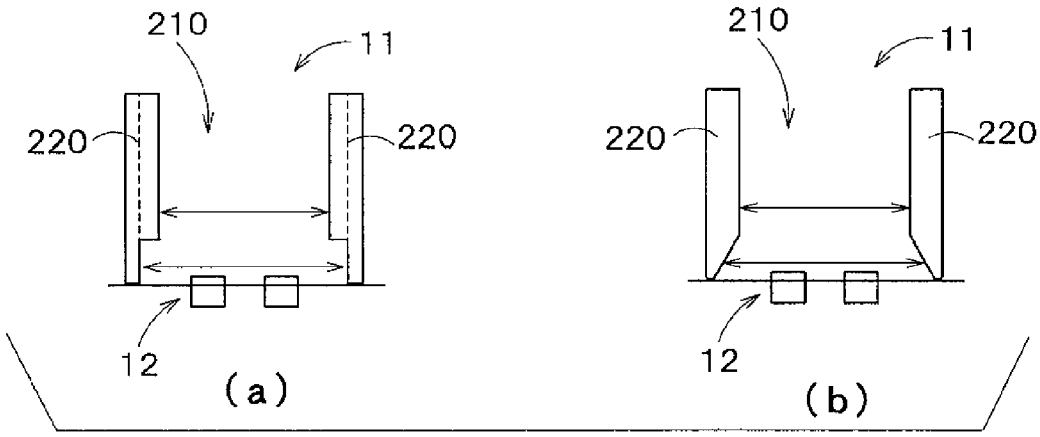
FIG. 12 are schematic front views of the hopper unit.

FIG. 12(*a*) is a schematic front view of the hopper unit 11 to which the width restricting members 220 are attached. As illustrated in FIG. 12(*a*), a lower portion (the vicinity of the feeding unit 12) of each width restricting member 220 is cut out, and a clearance is formed between the lower portion and a paper sheet setting surface of the feeding unit 12. This makes the width of the suspension region 210 of the hopper unit 11 larger.

In another embodiment, as illustrated in FIG. 12(*b*), the lower portion (the vicinity of the feeding unit 12) of each width restricting member 220 may be tapered. In short, the width of the suspension region 210 when the width restricting members 220 are attached may be larger in only a lower portion (the vicinity of the feeding unit 12) of the hopper unit 11.

Figure 13:
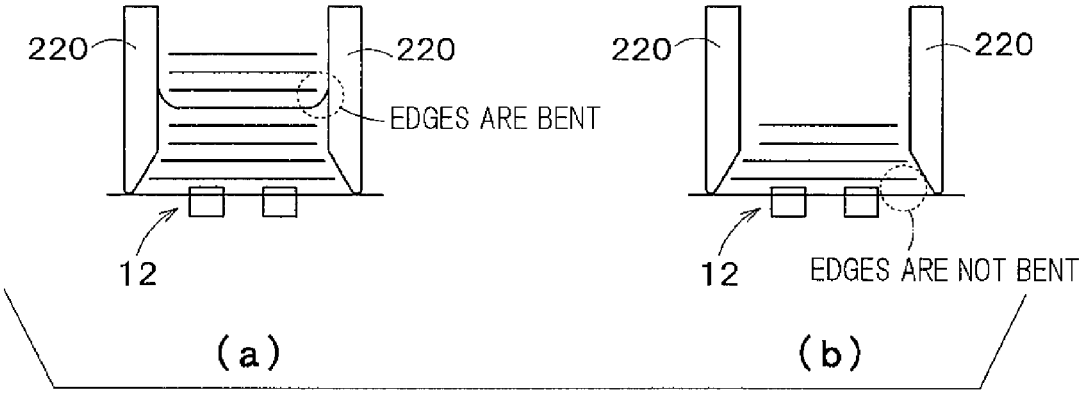
FIG. 13 are schematic front views of the hopper unit.

With this configuration, even if a large-sized paper sheet is put into the hopper unit 11 and edges thereof are bent as illustrated in FIG. 13(*a*), the width of the suspension region 210 is larger in the lower portion of the hopper unit 11 as illustrated in FIG. 13(*b*), and this enables the paper sheet to be fed by the feeding unit 12 while the edges thereof are not bent.

Figure 14:
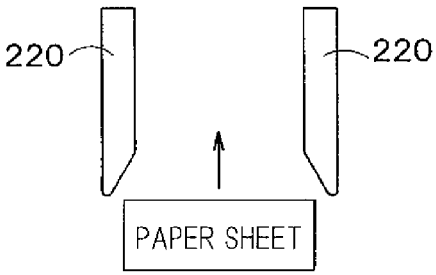
FIG. 14 is a schematic plan view of the hopper unit.

FIG. 14 is a schematic plan view (top view) of the hopper unit 11 to which the width restricting members 220 are attached. As illustrated in FIG. 14, portions of the width restricting members 220 on the paper sheet putting side are tapered. Hence, even in the case where the width of the suspension region 210 of the hopper unit 11 is smaller than the width (the length in the long edge direction) of a paper sheet to be put due to the width restricting members 220, the tapered portions make the paper sheet easier to put into the hopper unit 11.

In this way, if the width restricting members 220 are respectively provided in both the side portions of the hopper unit 11, it is possible to bring small-sized paper sheets together to the center. Hence, in the case where the small-sized paper sheets are bundled, it is possible to prevent edges of the paper sheets from protruding. Moreover, it is possible to easily put large-sized paper sheets into the hopper unit 11 and feed the large-sized paper sheets by the feeding unit 12 while edges thereof are not bent.

Note that the present invention is not directly limited to the above-mentioned embodiments, but it is possible to embody the present invention by modifying components within a range not departing from the gist thereof in its implementation phase. Moreover, it is possible to form various inventions by appropriately combining a plurality of components disclosed in the above-mentioned embodiments. For example, some of all the components disclosed in the above-mentioned embodiments may be omitted. Furthermore, components across different embodiments may be appropriately combined.

REFERENCE SIGNS LIST

1 paper sheet processing apparatus
2 paper sheet sorting/stacking apparatus
3 paper sheet bundling apparatus
22 bundling unit
71 stamp affixing unit
170 control unit
174 stamp affixing position determining unit
180 memory unit
11 hopper unit
12 feeding unit
220 width restricting member

The invention claimed is:

1. A paper sheet bundling apparatus comprising:

a bundling unit configured to bundle bundling target paper sheets using a bundling band and make a batch of paper sheets;

a stamp affixing unit configured to affix a stamp to a principal portion of the bundling band of the batch of paper sheets, the principal portion facing a principal surface which is a front surface or a back surface of the batch of paper sheets;

a memory unit configured to store therein an association between a kind of paper sheet and a stamp affixing position on the principal portion of the bundling band the stamp affixing position being determined based on irregularities that occur on the principal surface of the batch of paper sheets; and a control unit configured to obtain the stamp affixing position corresponding to the kind of the bundling target paper sheets with reference to the association, and adjust a positional relation between the stamp and the bundling band at a time of affixing the stamp, on a basis of the obtained stamp affixing position.

2. The paper sheet bundling apparatus according to claim 1, wherein the paper sheets are banknotes, and the kind includes a denomination.

3. The paper sheet bundling apparatus according to claim 2, wherein the kind includes face/back and orientation.

4. The paper sheet bundling apparatus according to claim 2, wherein the kind includes at least any one of fitness and the kind of banknote.

5. The paper sheet bundling apparatus according to claim 4, wherein the control unit obtains the stamp affixing position in accordance with a ratio of fit notes to unfit notes or a ratio of new version notes to old version notes, the notes being included in the batch of paper sheets.

6. The paper sheet bundling apparatus according to claim 4, wherein the control unit obtains the stamp affixing position in accordance with a ratio of face-up notes to face-down notes included in the batch of paper sheets or an orientation-based ratio.

7. The paper sheet bundling apparatus according to claim 1, wherein the control unit adjusts a position of the batch of paper sheets with respect to the stamp, on the basis of the obtained stamp affixing position.

8. The paper sheet bundling apparatus according to claim 1, wherein the control unit adjusts a position of the stamp with respect to the batch of paper sheets, on the basis of the obtained stamp affixing position.

9. A paper sheet bundling apparatus comprising:

a bundling unit configured to bundle bundling target paper sheets using a bundling band and make a batch of paper sheets;

a stamp affixing unit configured to affix a stamp to a principal portion of the bundling band of the batch of paper sheets, the principal portion facing a principal surface which is a front surface or a back surface of the batch of paper sheets;

a memory unit configured to store therein an association between a kind of paper sheet and a stamp affixing position on a principal surface of the paper sheet, the stamp affixing position being determined based on irregularities that occur on the principal surface of the batch of paper sheets; and a control unit configured to obtain the stamp affixing position corresponding to the kind of the bundling target paper sheets with reference to the association, and adjust a positional relation between the stamp and the batch of paper sheets at a time of affixing the stamp, on a basis of the obtained stamp affixing position.

* * * * *